US006068580A

United States Patent [19]

Myers et al.

[11] Patent Number: 6,068,580

[45] Date of Patent: May 30, 2000

[54] EXERCISE DEVICE

[75] Inventors: Randy J. Myers, West Palm Beach, Fla.; Karl M. Fickenscher; James E. Cotter, both of Ashland, Ohio

[73] Assignee: Hedstrom Corporation, Bedford, Pa.

[21] Appl. No.: 09/027,532

[22] Filed: Feb. 23, 1998

[51] Int. Cl.[7] ..... A63B 21/02

[52] U.S. Cl. ..... 482/93; 482/111; 482/907; 482/910; 446/220; 446/226; 473/596

[58] Field of Search ..... 482/111, 91, 93, 482/148, 122, 126, 907, 910, 77, 108; 446/220, 221, 224, 226; 473/596, 610, 611, 575

[56] References Cited

U.S. PATENT DOCUMENTS

| | | | |
|---|---|---|---|
| 2,941,219 | 6/1960 | Irving | 482/111 |
| 3,427,022 | 9/1966 | Ward | 446/153 |
| 4,108,428 | 8/1978 | Winterbottom | 272/76 |
| 5,114,371 | 5/1992 | Alonzo | 441/129 |
| 5,230,682 | 7/1993 | Myers | 482/122 |
| 5,242,348 | 9/1993 | Bates | 482/105 |
| 5,735,776 | 4/1998 | Swezey | 482/91 |

FOREIGN PATENT DOCUMENTS

| | | | |
|---|---|---|---|
| 2027351 | 2/1980 | United Kingdom | 446/220 |

*Primary Examiner*—Richard J. Apley
*Assistant Examiner*—Tam Nguyen
*Attorney, Agent, or Firm*—Cesari and McKenna, LLP

[57] ABSTRACT

An exercise device comprises a relatively large diameter ball having a pair of handles projecting from opposite sides of the ball. To use the device, one may grasp one or both handles and manipulate the device following specific exercise routines.

3 Claims, 2 Drawing Sheets

EXERCISE DEVICE

This invention relates to an exercise device. It relates more particularly to a hand-held exercise device to facilitate various stretching and flexing exercises.

BACKGROUND OF THE INVENTION

When exercising the body, people may use various devices to encourage certain body motions and/or to exercise certain muscles of the body. These devices include wrist weights, hand-held dumbbells, batons and the like. Also, weighted balls, i.e., medicine balls, have long been used to improve muscle tone. These balls may be hefted and thrown up and down by a single person or thrown back and forth by two or more people to exercise each user's arms and torso.

All of these prior devices are quite satisfactory in many respects. However, they lack versatility. In other words, they can usually only be used in one way to exercise only one set of body muscles. Thus, it would be desirable to provide an exercise device that could be used in a variety of different ways to exercise different parts of the body and to hold the users interest during different exercise routines.

SUMMARY OF THE INVENTION

Accordingly, it is an object of the invention to provide an improved exercise device.

Another object of the invention is to provide a hand-held inflatable exercise device which may be used in a variety of different ways in the performance of an exercise program.

Another object of the invention is to provide an exercise device which is collapsible so that it can be stored and transported in a minimum amount of space.

A further object of the invention is to provide an exercise device which is relatively easy and inexpensive to manufacture in quantity.

Other objects will, in part, be obvious and will, in part, appear hereinafter.

The invention accordingly comprises the apparatus embodying the features of construction, and arrangement of parts exemplified in the following detailed description. The scope of the invention will be indicated in the claims.

Briefly, the exercise device comprises a relatively large inflatable ball having handles extending from diametrically opposite sides of the ball. Preferably, the ball includes a valve so that the ball can be pressurized with air and deflated when not in use for compact storage.

During an exercise routine, the user may grasp one or more handles of the device and manipulate the device in various ways to be described in more detail later to stretch, flex and exercise various body muscles to obtain maximum benefit from an exercise program.

The exercise device may be molded of a suitable resilient rubber or plastic material so that it is relatively inexpensive to make in quantity. Therefore, it should find wide acceptance in the marketplace.

BRIEF DESCRIPTION OF THE DRAWINGS

For a fuller understanding of the nature and objects of the invention, refer to the following detailed description taken in connection with the accompanying drawings, in which.

DETAILED DESCRIPTION OF THE PREFERRED EMBODIMENT

Figure 1:
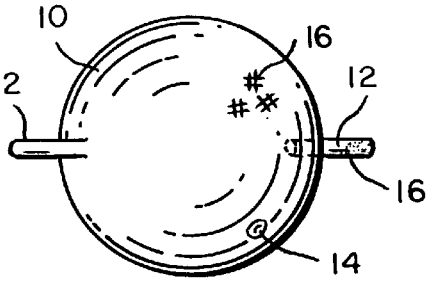
FIG. 1 is an isometric view of an exercise device according to the invention.

Referring to FIG. 1 of the drawing, the exercise device comprises an inflatable ball or bladder 10 having a pair of handles 12 extending out from opposite sides of the ball 10. The illustrated ball is round and the handles 12 are cylindrical. However, the ball and handle could just as well have other shapes. For example, the ball could be octahedral and the handles could be rings, ears or some other shape which may be grasped easily by the hand.

Ball 10 may be inflated to a diameter of 12 to 18 inches depending on the size of the user, and each handle 12 may be in the order of 1 to 2 inches in diameter and 4 to 6 inches long. Also, the handles may be solid or they may be hollow and in fluid communication with the interior of ball 10 as shown in phantom in FIG. 1.

Preferably, the ball 10 includes a valve 14 which may be used to inflate the ball 10 when the device is in use and to deflate the ball so that the device can be stored in a minimum amount of space.

The ball 10 and handles 12 may be molded of any suitable rugged, impact-resistant resilient material such as PTFE, rubber, etc. If desired, the outer surface of the device, particularly the handles 12, may be textured as shown at 16 in FIG. 1 to minimize slippage.

When using the exercise device, one may hold one of the handles 12 with either hand or both of the handles 12 with both hands and move the device around following specific exercise routines some of which are described below in connection with FIGS. 2A to 2F.

Figure 2A:
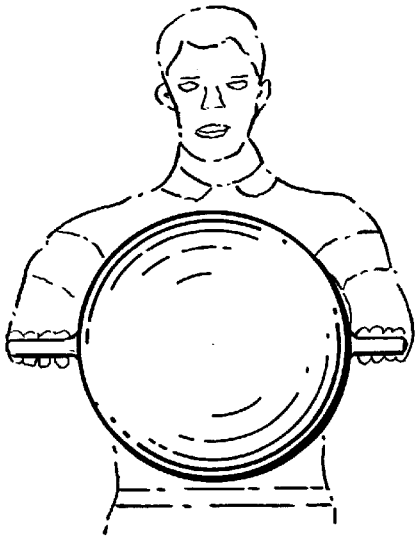
FIGS. 2A to 2F are diagrammatic views illustrating various uses of the FIG. 1 device during an exercise program.

FIG. 2A-Forearm, Curls: Hold onto the device with both hands, palms facing down. Curl wrists up and down, rotating the ball in the hands. Repeat 25 times.

Figure 2B:
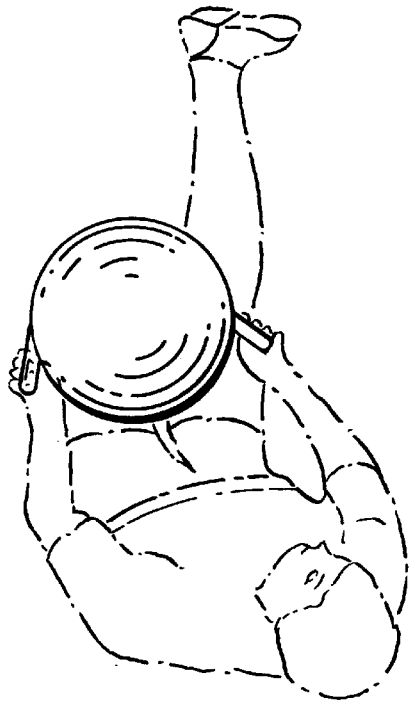

FIG. 2B-Single Leg Extension: Lay flat on back with one knee bent and other leg extended up in the air. Place the ball 10 behind the extended leg. Slowly pull on the handles 12 to increase stretch. Repeat 10 times with each leg.

Figure 2C:
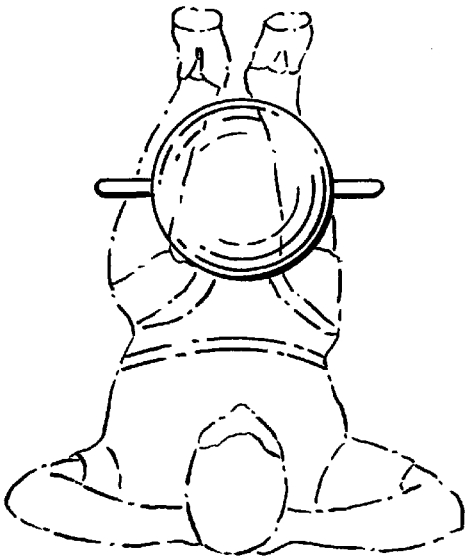

FIG. 2C-Knee Raises: Lay flat on back and place the device between hamstrings and calves. Slowly raise knees up toward the chest, keeping the abdominal muscles tight. Lower legs back down. Repeat 10 times.

Figure 2D:
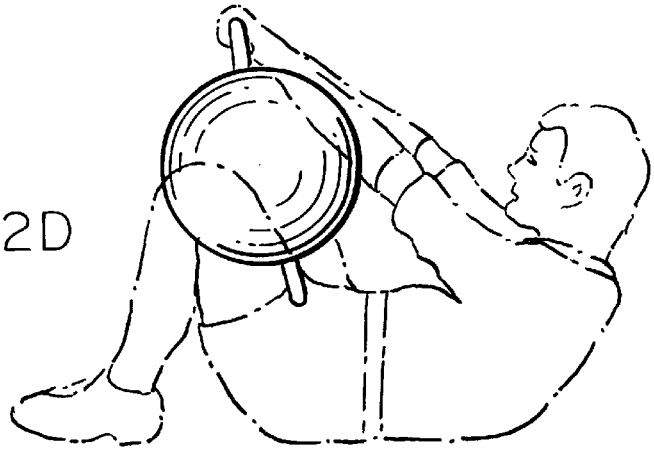

FIG. 2D-Abdominal Crunch: Lay flat on back with knees bent. Place the ball 10 between the thighs and extend the arms up in the air. Using the handle 12 as a target, slowly raise upper body off of the floor. Squeeze in on the ball while lowering back down. Repeat 10 times.

Figure 2E:
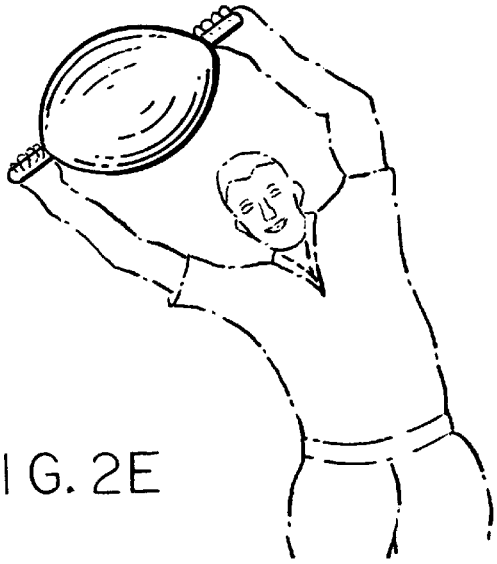

FIG. 2E-Side Bends: Hold the device over the head, and stand with feet a shoulder width apart. Slowly bend from side to side, pulling out on the handles 12. Repeat 10 times in each direction.

Figure 2F:
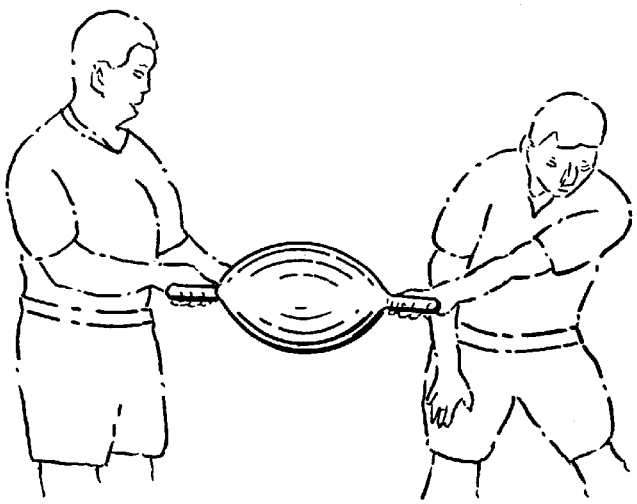

FIG. 2F-Assisted Rear Shoulder Stretch: Holding the device in one hand, set up in a golf stance. Slowly extend the ball 10 across the body, allowing a partner to pull on the ball. Keep the arm extended while making a full turn. Hold the stretch for 10 seconds. Repeat 5 times with each arm.

Of course many other exercise routines using the device may be envisioned to increase one's strength and flexibility including squats, lunges, hamstring curls and the like.

With all of its advantages, the exercise device is still relatively inexpensive to make.

It will thus be seen that the objects set forth above, among those made apparent from the preceding description, are efficiently attained and, since certain changes may be made in the construction set forth without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention described herein.

What is claimed is:

1. An exercise device comprising an inflatable ball having a resilient wall and a hollow interior, a pair of resilient handles integrally formed with said wall and projecting from opposite sides of the ball, wherein said handles have hollow interiors which are in fluid communication with the interior of the ball so as to be inflated simultaneously therewith, and wherein substantially the entire exterior surface of the device has a non-slip surface, and an inflation means in said wall by which said ball may be inflated.

2. The exercise device defined in claim 1 wherein the ball is round and the handles are cylindrical.

3. The exercise device defined in claim 2 wherein the ball has a diameter in the range of 12 to 18 inches.

* * * * *